United States Patent [19]

Uchida et al.

[11] Patent Number: 4,770,609

[45] Date of Patent: Sep. 13, 1988

[54] TWO-STAGE VACUUM PUMP APPARATUS AND METHOD OF OPERATING THE SAME

[75] Inventors: Riichi Uchida; Seiji Tsuru, both of Ibaraki; Kazuaki Shiinoki; Kotaro Naya, both of Ebina, all of Japan

[73] Assignee: Hitachi, Ltd., Tokyo, Japan

[21] Appl. No.: 25,977

[22] Filed: Mar. 16, 1987

[30] Foreign Application Priority Data

Apr. 14, 1986 [JP] Japan ..... 61-85636

[51] Int. Cl.[4] ..... F04B 49/00; F04B 49/06; F04B 1/34

[52] U.S. Cl. ..... 417/2; 417/247; 418/3; 418/9; 418/13

[58] Field of Search ..... 417/2, 247; 418/3, 9, 418/13, 201

[56] References Cited

U.S. PATENT DOCUMENTS

| | | | |
|---|---|---|---|
| 2,958,455 | 11/1960 | Steinherz et al. | 417/2 |
| 3,910,731 | 10/1975 | Persson | 418/201 |
| 3,922,110 | 11/1975 | Huse | 417/2 |
| 4,068,984 | 1/1978 | Spindler | 418/200 |
| 4,225,288 | 9/1980 | Mugele | 417/2 |
| 4,283,167 | 8/1981 | Bassan | 418/13 |
| 4,487,563 | 12/1984 | Mori | 418/201 |
| 4,523,897 | 6/1985 | Lower | 418/13 |
| 4,601,643 | 7/1986 | Seidel | 417/247 |
| 4,664,601 | 5/1987 | Uchida | 417/45 |
| 4,666,385 | 5/1987 | Ohamoto | 413/201 |

*Primary Examiner*—William L. Freeh

*Attorney, Agent, or Firm*—Antonelli, Terry & Wands

[57] ABSTRACT

A two-stage vacuum pump apparatus has a first stage of vacuum pump constituted by a screw-type vacuum pump and a second stage vacuum pump constituted by an oil-sealed rotary vacuum pump operative to maintain the back pressure of the first stage vacuum pump at a level ranging from 1 to 100 Torr., whereby a high level of vacuum can be attained in a system to be evacuated without any risk of contamination of the evacuated system by oil. Also disclosed is a method of operating the two-stage vacuum pump apparatus.

5 Claims, 6 Drawing Sheets

TWO-STAGE VACUUM PUMP APPARATUS AND METHOD OF OPERATING THE SAME

BACKGROUND OF THE INVENTION

The present invention relates to a two-stage vacuum pump apparatus for evacuating, to a high level of vacuum, a space in which a work has to be conducted under such a high level of vacuum. The invention is also concerned with a method of operating such a two-stage vacuum pump apparatus.

One of the important requisites for a vacuum pump apparatus is to prevent a system to be evacuated from being contaminated by oil. A roots pump is known to be capable of satisfying such a demand to a high extent. In general, however, the roots pump can develop only a low compression ratio, so that it is combined, as proposed in Japanese Unexamined Utility Model Publication No. 5789/1984, with an oil-sealed rotary vacuum pump in order to produce a medium level of vacuum on the order of $10^{-2}$ to $10^{-4}$ Torr. and higher levels of vacuum. The compression ratio developed by a roots pump is as low as 2 to 5 in the atmospheric pressure region (about 760 Torr.) and does not exceed 20 to 70 even in the medium pressure region of $10^{-2}$ to $10^{-4}$ Torr. It is, therefore, required to connect the outlet side of the roots pump with an oil-sealed rotary vacuum pump which is capable of operating to attain a higher compression ratio. In such a case, a pressure difference on the order of 1 to $10^{-3}$ Torr. is developed across the oil-sealed rotary vacuum pump. When the oil-sealed rotary vacuum pump operates in such a condition, vigorous vaporization of the sealing oil takes place in this pump, causing a risk that the evacuated system is contaminated by the vaporized oil transferred through the roots pump.

U.S. patent application Ser. No. 701,199 proposes to use a screw pump under atmospheric back pressure (760 Torr.). The use of the screw pump, however, is not preferred because this type of pump consumes a large electric power and requires a large amount of torque at the time of start up, thus necessitating the use of a driving motor which is capable of producing a torque much greater than the torque required during steady evacuating operation.

SUMMARY OF THE INVENTION

Accordingly, an object of the present invention is to provide a two-stage vacuum pump apparatus, as well as a method of operating the same, capable of attaining a high level of vacuum without any risk for the evacuated system to be contaminated by oil.

Another object of the present invention is to provide a two-stage vacuum pump apparatus, as well as a method of operating the same, capable of preventing the evacuated system from being contaminated by oil, while reducing the power consumption.

Still another object of the present invention is to provide a two-stage vacuum pump apparatus, as well as a method of operating the same, capable of preventing the evacuated system from being contaminated by oil, and capable of starting with small starting torque.

According to one aspect of the present invention, there is provided a two-staged vacuum pump apparatus comprising a first stage constituted by a screw vacuum pump and a second stage constituted by an oil-sealed rotary vacuum pump.

According to another aspect of the invention, there is provided a method of operating a vacuum pump apparatus in which a vacuum pump of a first stage and a vacuum pump of a second stage are operated to maintain therebetween a pressure difference on the order of 1 to 100 Torr.

In general, a screw-type vacuum pump can operate to provide a high compression ratio even in a pressure region near the atmospheric pressure. In addition, a special screw-type vacuum pump known as "oil-free" type does not cause any contamination of the evacuated system by oil, as disclosed in the specification of U.S. patent application Ser. No. 701,199. However, the following problems are encountered when the vacuum pump apparatus is constituted solely by a single stage constituted by the screw-type vacuum pump:

(I) Since the flow of the gas in the working chamber near the discharge port is a viscous flow, the performance of the vacuum pump is largely affected by any leak through a gap between rotors.

(II) When the pump is of oil-free type, the temperature at the discharge side rises excessively because there is no oil which would effect cooling.

(III) The starting torque required for start up at the atmospheric pressure is very large as compared with the driving torque required in steady condition of operation.

All these problems are experienced particularly when the pump operates with the back pressure maintained at the atmospheric level and, therefore, can be overcome by adopting a two-staged construction of the pump apparatus consisting of a first stage constituted by a screw type vacuum pump and a second stage constituted by another type of vacuum pump.

A test was conducted to examine changes in operation characteristics of the vacuum pump apparatus in response to changes in the back pressure of the screw-type vacuum pump and the peripheral speed of the rotor of the screw-type vacuum pump.

FIG. 5 shows the relationship between the back pressure and the compression ratio, using the rotor peripheral speed as a parameter. From this Figure, it will be seen that the peripheral speed of the rotor must be high in order that a high compression ratio may be obtained when the back pressure is maintained at the same level as the atmospheric pressure. However, when the back pressure is as low as 1 to 100 Torr., a considerably high compression ratio can be obtained even when the peripheral speed of the rotor is lower.

FIG. 6 shows the relationship between the back pressure and the power ratio (ratio of shaft power to mechanical loss), using the rotor peripheral speed as a parameter. When the back pressure is below 100 Torr., the power ratio is substantially "1", so that the screw-type vacuum pump can operate only by power input substantially equal to the mechanical loss of power.

Thus, by using a screw-type vacuum pump as the first stage, it is possible to obtain a high compression ratio on the order of $10^3$ to $10^4$ even when the back pressure ranges between 1 and $10^2$ Torr. In addition, the pump input power is not substantially changed when the back pressure is as low as $10^2$ Torr. or less.

Thus, in the pump apparatus of the present invention, a screw-type vacuum pump is used as the vacuum pump of the first stage, so that a large compression ratio can be obtained even in the operating region of a higher back pressure, as compared with the conventional vacuum pump apparatus which employs a roots pump as the vacuum pump of the first stage. Therefore, according to the invention, it is possible to attain a high level of vacuum which is of the same level as that attained by the known two-stage vacuum pump apparatus composed of a roots pump and an oil-sealed rotary vacuum pump, e.g., $10^{-3}$ to $10^{-4}$ Torr., even when the second stage is constituted by such a vacuum pump that can produce only a low level of vacuum on the order of several to several tens of Torr. In addition, a vacuum pump having a small evacuating speed can be used as the vacuum pump of the second stage.

This means that an oil-free type vacuum pump capable of producing only a low level of vacuum, e.g., a diaphragm pump, can be used as the vacuum pump of the second stage. When such an oil-free vacuum pump is used as the vacuum pump of the second stage connected to the outlet side of the first stage constituted by a screw-type vacuum pump which also is oil-free, any risk for the evacuated system to be contaminated by oil is completely eliminated.

According to the invention, it is also possible to use an oil-sealed rotary vacuum pump as the vacuum pump of the second stage. As stated before, the critical pressure level at which the diffusion of oil by evaporation generally takes place in the case of the oil-sealed vacuum pump used as the second stage ranges between 0.1 and 1 Torr. Therefore, the oil-sealed rotary vacuum pump used as the vacuum pump of the second stage does not cause diffusion of oil into the evacuated system provided that the suction pressure of the second stage, i.e., the back pressure of the first stage, is not lower than 1 Torr.

DESCRIPTION OF THE PREFERRED EMBODIMENTS

Preferred embodiments of the present invention will be described hereinunder with reference to the accompanying drawings.

Figure 1:
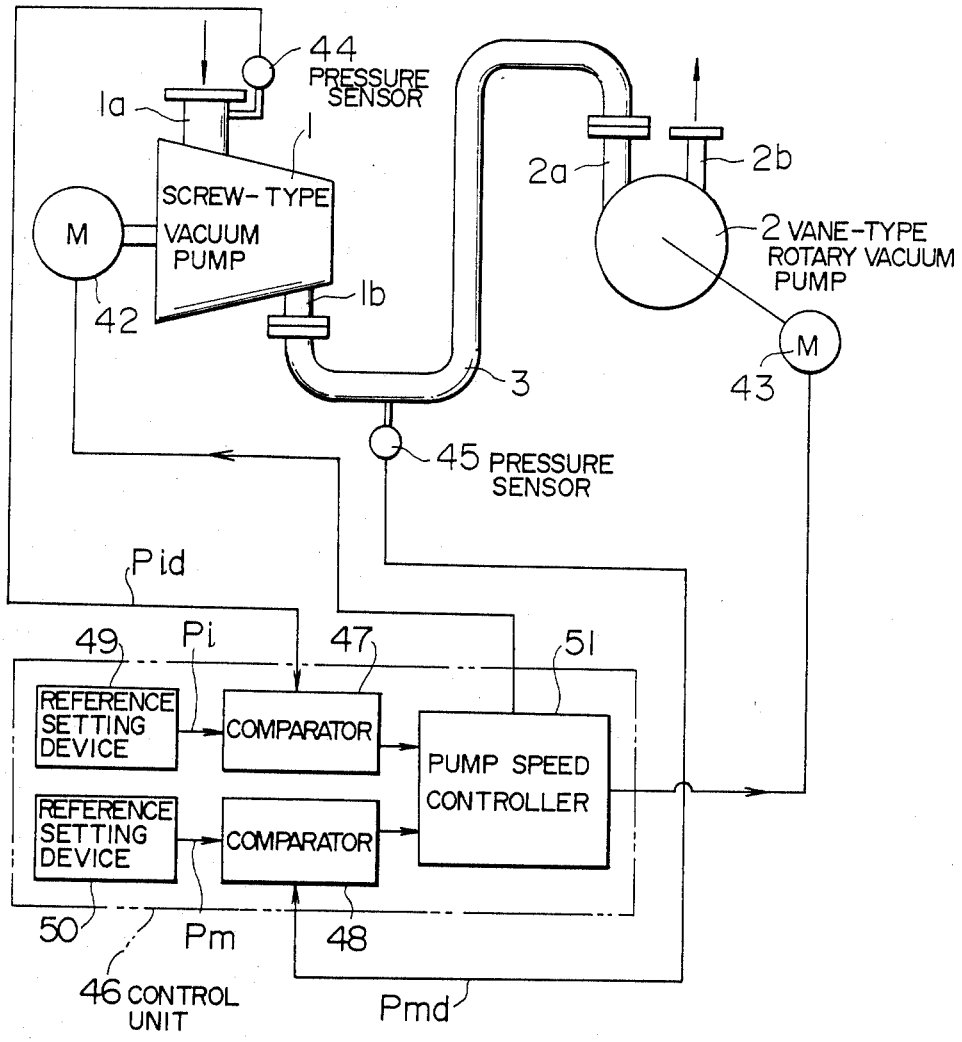
FIG. 1 is a diagrammatic illustration of an embodiment of a two-stage vacuum pump apparatus in accordance with the present invention.

FIG. 1 diagrammatically illustrates an embodiment of a two-stage vacuum pump apparatus in accordance with the present invention. As will be seen from this Figure, the vacuum pump apparatus of this embodiment has a two-staged construction composed of a first stage constituted by a screw-type vacuum pump 1 and a second stage constituted by an oil-sealed rotary vacuum pump 2. The vacuum pump 1 has a suction port 1*a* which is communicated with a system (not shown) to be evacuated and a discharge port 1*b* which is connected through a pipe 3 to a suction port 2*a* of the oil-sealed rotary vacuum pump 2. The discharge port 2*b* of the oil-sealed rotary vacuum pump 2 is opened to atmosphere.

Figure 2:
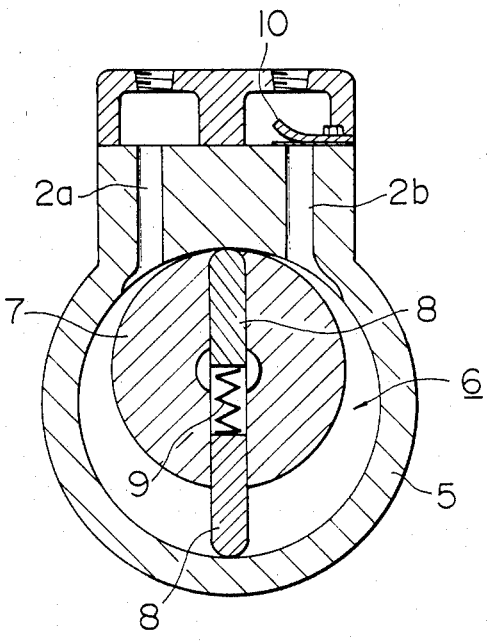
FIG. 2 is a cross-sectional view of an oil-sealed rotary vacuum pump which can be incorporated in the embodiment shown in FIG. 1.

The oil-sealed rotary vacuum pump 2 may be a vane-type pump shown in FIG. 2 which is known per se. The vane-type oil-sealed rotary vacuum pump 2 has a casing 5 defining a cylindrical working chamber 6 and a rotor 7 which is rotatably and eccentrically disposed in the working chamber 6. The rotor 7 has radial slots which receive a pair of vanes 8 urged by a spring 9 into pressure contact with the inner peripheral surface of the working chamber 6. The vane-type oil-sealed rotary vacuum pump has a check valve 10 provided at the discharge port 2*b* thereof. An electric motor 43 is connected to the rotor 7.

Figure 3:
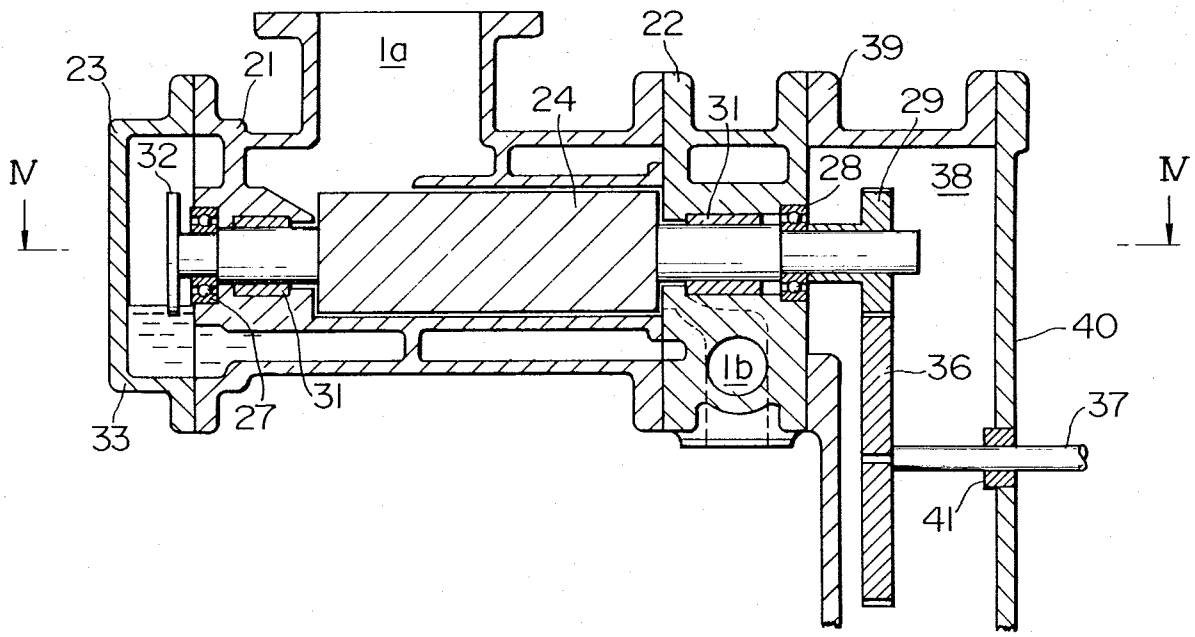
FIG. 3 is a longitudinal sectional view of a screw-type vacuum pump used in the embodiment shown in FIG. 1.
Figure 4:
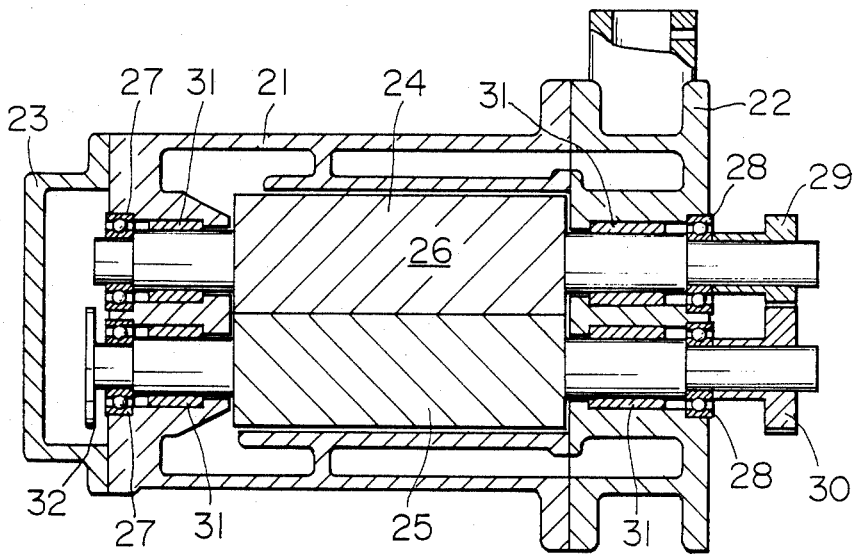
FIG. 4 is a sectional view taken along the line IV—IV in FIG. 3.

FIGS. 3 and 4 are a longitudinal sectional view of the screw-type vacuum pump 1 and a sectional view taken along the line IV—IV in FIG. 3, respectively. The screw-type vacuum pump 1 has a main casing 21 defining a working chamber 26, a discharge casing 22 and an end cover 23. The main casing 21 accommodates a male rotor 24 and a female rotor 25 which meshes with the male rotor. The main casing 21 and the discharge casing 22 cooperate to define the working chamber 26. The male and female rotors 24 and 25 meshing with each other are mounted for rotation in the working chamber 26. The rotors 24 and 25 have shafts which are rotatably supported by bearings 27 and 28. A male timing gear 29 and a female timing gear 30 are fixed to the ends of the shafts of respective rotors projecting beyond the discharge casing 22. These timing gears 29 and 30 are so designed and assembled that the male rotor 24 and the female rotor 25 can rotate in such a manner that a slight gap is always maintained therebetween. For further detail of the screw-type vacuum pump of the type described, a reference should be made to U.S. patent application Ser. No. 701,199, the disclosure therein being incorporated herein by reference. Shaft seals 31 are provided between the shafts of the respective rotors 24 and 25 and the casings 21 and 22 at positions axially inward of the bearings 27 and 28, respectively. These shaft seals 31 prevent a lubricating oil from flowing into the working chamber 26 from the bearings 27 and 28 and gears 29 and 30 to which the lubricating oil is supplied. An example of the shaft seals usable in this apparatus is disclosed in U.S. Pat. No. 4,487,563.

A slinger 32 is fixed to the end of the female rotor 25 projected into the end cover 23. The slinger splashes the lubricating oil stored in an oil reservoir 33 formed by a bottom portion of the end cover 23 and a part of the main casing 21, thereby supplying the lubricating oil to the bearing 27. The working chamber 26 is communicated at its one end with the suction port 1*a* formed in the main casing 21 and at its other end with the discharge port 1*b* formed in the discharge casing 22.

The male timing gear 29 is drivingly connected to a drive shaft 37 through a drive gear 36. The drive shaft 37 is drivingly connected to an electric motor 42. The timing gears 29 and 30 and the drive gear 36 are received in a gear chamber 38 which is defined by a gear casing 39 and a side plate 40. The shaft 37 therefore extends through a bore formed in the side plate 40. A shaft seal 41 is provided between the drive shaft 37 and the side plate 40 to form an oiltight seal therebetween.

A pressure sensor 44 is provided so as to detect the pressure at the suction port 1*a* of the screw-type vacuum pump 1, while another pressure sensor 45 is disposed so as to detect the pressure in the pipe 3 or at the discharge port 1*b*. These pressure sensors 44 and 45 are adapted for producing voltages corresponding to respective pressures.

A control unit 46 has a pair of comparators 47 and 48, a pair of reference setting devices 49 and 50 and a pump speed control device 51. The first comparator 47 is adapted for comparing a suction pressure $P_{id}$ sensed by the pressure sensor 44 with a reference suction pressure $P_i$ which is preset by the first reference setting device 49. The second comparator 48 compares a back pressure $P_{md}$ sensed by the pressure sensor 45 with a reference back pressure ranging between 1 to 100 Torr. which is preset by the second reference setting device 50.

The first comparator 47 is adapted to deliver a speed increasing signal in the condition of $P_{id} > P_i$ and deliver a speed decreasing signal in the condition of $P_{id} < P_i$. When the pressures $P_{id}$ and $P_i$ are substantially equal to each other, the first comparator 47 produces a signal for maintaining the speed unchanged. The pump speed control device 51 operates in response to the output signal from the first comparator 47 to control the speed of the motor 42 so as to maintain the actual suction pressure $P_{id}$ substantially at the same level as the reference suction pressure $P_i$.

The second comparator 48 is adapted for producing a speed increasing signal in the condition of $P_{md} > P_m$ and a speed decreasing signal in the condition of $P_{md} < P_m$. The pump speed control device 51 controls the speed of the electric motor 43 in accordance with the output from the second comparator 48, thereby maintaining the actual back pressure $P_{md}$ substantially at the same level as the reference back pressure $P_m$.

The operation of this embodiment will be described hereinunder. First, the oil-sealed rotary vacuum pump 2 is started so as to reduce the pressure in the system to be evacuated connected to the suction port 1*a* of the screw-type vacuum pump 1, in the working chamber 26 in the screw-type vacuum pump and in the pipe 3 from the atmospheric level (760 Torr.) down to about 100 Torr. Then, the screw-type vacuum pump 1 is started so as to further reduce the pressure in the evacuated system. The final pressure in the evacuated system can be adjusted by controlling the back pressure of the screw-type vacuum pump 1 constituting the first stage and the peripheral speed of the rotor 7. The control of the speed of the screw rotors can be effected by an apparatus which is disclosed in U.S. patent application Ser. No. 758,032 (now allowed). For instance, the final pressure can be reduced, i.e., the level of the vacuum attained in the evacuated system can be increased, by increasing the peripheral speed of the screw rotors or by lowering the back pressure of the screw-type vacuum pump of the first stage.

As explained before, it is necessary that the back pressure of the first stage pump, i.e., the pressure between the first and second stages of pumps, is maintained at a level above the critical pressure (0.1 to 1.0 Torr.) at which the vaporization of the oil takes place in the oil-sealed rotary vacuum pump 2 constituting the second stage of the vacuum pump apparatus. Such a method of operating the two-stage vacuum pump system can effectively prevent diffusion of oil and, therefore, contamination of the evacuated system with oil.

It is also to be noted that the back pressure of the screw-type vacuum pump 1 constituting the first stage is maintained so as not to exceed 100 Torr., so that the power ratio of the screw-type vacuum pump 1 can equal substantially to 1 so as to enable a small-sized driving motor to drive this vacuum pump.

Figure 5:
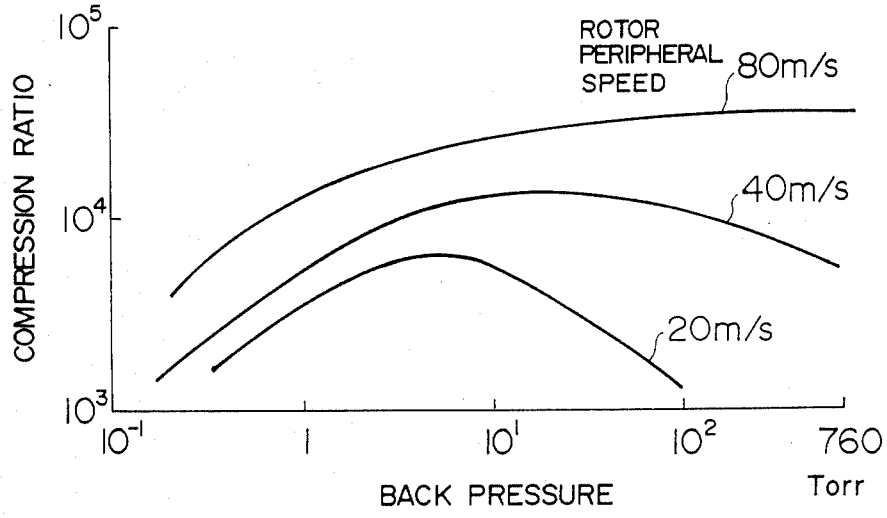
FIGS. 5 and 6 are graphs which show the operation characteristics of the screw-type vacuum pump used in the two-stage vacuum pump apparatus embodying the present invention.
Figure 6:
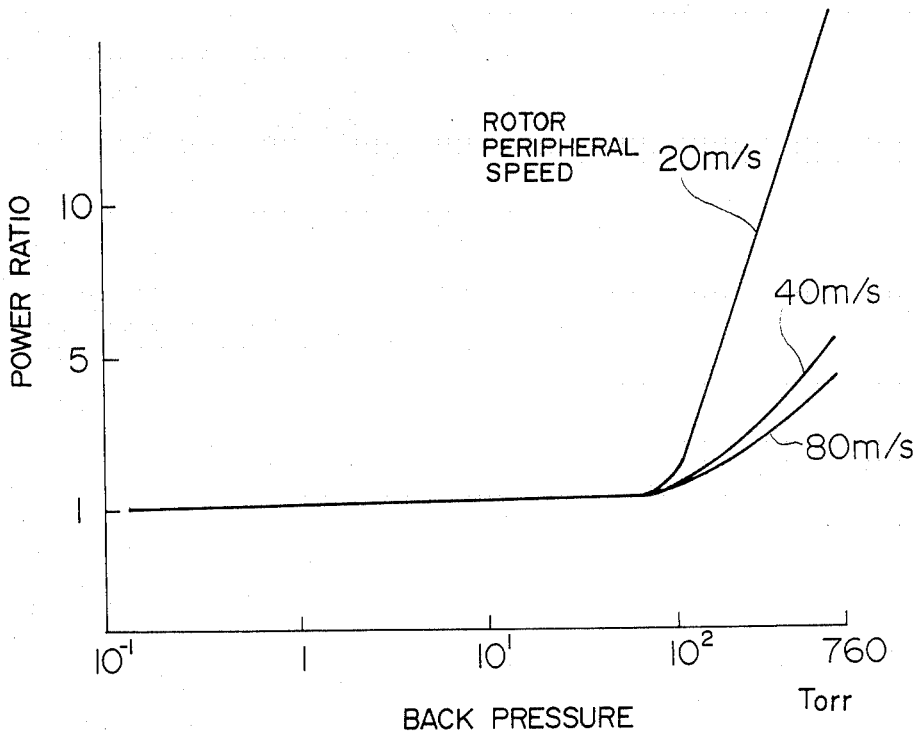

If the vacuum pump apparatus has only a single stage constituted by a screw-type vacuum pump and is operated with its back pressure maintained at the level of the atmospheric pressure, it is necessary to maintain a high peripheral speed of the rotors in order to obtain a high compression ratio, as will be seen from FIG. 5. When the rotation speed is high, a contact-type sealing device such as the shaft seal 31 cannot be used. According to the invention, the screw-type vacuum pump is used as the vacuum pump of the first stage in a two-stage vacuum pump apparatus, so that it can develop a considerably high compression ratio because its back pressure can be maintained by the vacuum pump of the second stage at a low level ranging between 1 and 100 Torr. even when the peripheral rotor speed in the screw-type pump is low. It is, therefore, possible to use a contact-type sealing device such as the shaft seal 31 in the screw-type vacuum pump.

As has been described, the invention provides a two-stage vacuum pump apparatus in which the first stage is constituted by a screw-type vacuum pump. Therefore, the screw-type vacuum pump can operate with its back pressure maintained at a level sufficiently lower than the atmospheric pressure. This eliminates all the problems which are encountered by a single-stage vacuum pump apparatus constituted by a screw-type vacuum pump. In addition, since the screw-type vacuum pump of the first stage can operate to attain a sufficiently high compression ratio, it is possible to use a vacuum pump capable of producing only a low level of vacuum as the vacuum pump of the second stage, e.g., an oil-free diaphragm pump. The use of an oil-free vacuum pump as the second stage pump completely eliminates contamination of the evacuated system with oil.

According to the operation method of the present invention, the vacuum pump apparatus is operated such that the back pressure of the first stage pump is maintained at a level between 1 and 100 Torr. which is higher than the critical pressure level at which the evaporation of lubricating oil takes place. This is effective to lower the power required for the driving of the pump apparatus and prevent any oil contamination of the evacuated system even when an oil-sealed rotary vacuum pump is used as the second stage pump of the two-stage vacuum pump apparatus.

What is claimed is:

1. A two-stage vacuum pump apparatus comprising:

a first stage screw-type vacuum pump having a suction port connected to a system to be evacuated and adapted to be driven by a first electric motor;

a second stage vacuum pump connected to a discharge port of said first stage vacuum pump and adapted to be driven by a second electric motor;

a first pressure sensing means for sensing the pressure in said suction port of said first stage vacuum pump;

a second pressure sensing means for sensing the pressure in said discharge port of said first stage vacuum pump; and a control unit including a reference suction pressure setting means for presetting a first reference level for the suction pressure at said suction port, a reference back pressure setting means for presetting a second reference level for the back pressure at said discharge port of said first stage vacuum pump, a first comparator for comparing said first reference level with the level of the suction pressure sensed by said first pressure sensing means to generate a first speed changing signal for said first electric motor, a second comparator for comparing said second reference level with the level of the back pressure sensed by said second pressure sensing means to generate a second speed changing signal for said second electric motor, and a speed controlling means responsive to said first and second speed changing signals from said first and second comparators to control the speeds of said first and second electric motors.

2. A two-stage vacuum pump apparatus according to claim 1, wherein said second reference level preset in said control unit ranges from 1 to 100 Torr.

3. A two-stage vacuum pump apparatus according to claim 1, wherein said first stage vacuum pump includes a main casing defining therein a first working chamber communicated with said suction and discharge ports, a pair of male and female screw rotors rotatably mounted in said first working chamber and having shafts, bearing means rotatably supporting the shafts of said screw rotors, shaft seal means provided between the respective bearing means and said first working chamber, and a pair of timing gears meshing each other and fixed to the shafts of the respective screw rotors, and wherein said second stage vacuum pump includes a casing defining therein a second working chamber, a further rotor rotatably disposed in said second working chamber and having at least one slot formed therein, and a vane slidably received in said slot and movable in a radial direction of said further rotor.

4. A two-stage vacuum pump apparatus according to claim 1, wherein said first stage vacuum pump includes:

a casing defining therein a working chamber in the form of two cooperating cylinders and communicated with said suction and discharge ports, a pair of male and female screw rotors disposed in meshing engagement with each other and rotatably received in said working chamber, said rotors having shafts;

bearing means disposed between the respective shafts of said screw rotors and said casing to rotatably support said screw rotors;

sealing means disposed between said bearing means and said working chamber to prevent leakage of gases and oil mist suspended thereby between said working chamber and said bearing means; and a pair of timing gears mounted on said shafts of the respective screw rotors and disposed in meshing engagement with each other.

5. A two-stage vacuum pump apparatus according to claim 4, wherein said discharge port of said first stage vacuum pump is connected through a pipe line to a suction port of said second stage vacuum pump.

* * * * *